US006966478B2

(12) United States Patent
Adams et al.

(10) Patent No.: US 6,966,478 B2
(45) Date of Patent: Nov. 22, 2005

(54) COMBUSTION APPARATUS HAVING COLLAPSIBLE VOLUME

(75) Inventors: Joseph S. Adams, Salt Spring Island (CA); James E. Doherty, Barrington, IL (US); Donald L. Van Erden, Wildwood, IL (US)

(73) Assignee: Illinois Tool Works Inc, Glenview, IL (US)

( * ) Notice: Subject to any disclaimer, the term of this patent is extended or adjusted under 35 U.S.C. 154(b) by 7 days.

(21) Appl. No.: 10/700,082

(22) Filed: Nov. 3, 2003

(65) Prior Publication Data

US 2005/0092807 A1 May 5, 2005

(51) Int. Cl.[7] ..... B25C 1/08
(52) U.S. Cl. ..... 227/10; 227/130; 123/46 SC
(58) Field of Search ..... 227/9, 10, 130; 123/46 SC

(56) References Cited

U.S. PATENT DOCUMENTS

| | | | |
|---|---|---|---|
| 4,712,379 | A | 12/1987 | Adams et al. |
| 4,717,060 | A | 1/1988 | Cotta |
| 4,773,581 | A | 9/1988 | Ohtsu et al. |

(Continued)

FOREIGN PATENT DOCUMENTS

| | | |
|---|---|---|
| DE | 199 62 711 | 5/2001 |
| DE | 100 28 555 | 9/2001 |
| DE | 199 62 695 | 12/2001 |

OTHER PUBLICATIONS

Nishikawa et al., Combustion Type Power Tool, Aug. 26, 2004, United States Application Publication, US 2004/0164117.*

Chimento et al. "Minimally invasive total hip arthroplasty", *Operative Techniques in Orthopaedics*, vol. 11, No. 4, pp. 270–273 (2001).

Wenz et al. "Mini–incision total hip anthroplasty: a comparative assessment of perioperative outcomes". *Orthopedics*, vol. 25, No. 10, pp. 1031–1043 (2002).

Berger, "Mini–inicisions: two for the price of one". *Orthopedics*, vol. 25, No. 5 (2002).

Waldman. "Minimally invasive total hip replacement and perioperative management: early experience". *Journal of the Southern Orthpaedic Association*, vol. 11, No. 4, pp. 213–217 (2002).

Berger. "The techniques and early results of the minimally invasive total hip arthroplasty". Symposia F presented at Advances in minimally invasive surgery of the Hip, New Orleans, LA (Feb. 5–9, 2003).

The Zimmer Institute Surgical Technique. "Minimally invasive total hip arthroplasty. the 2–incision procedure with VerSys beaded fullcoat plus and trilogy acetabular system". The Zimmer Institute (2003).

*Primary Examiner*—Scott A. Smith
*Assistant Examiner*—Gloriar R. Weeks
(74) *Attorney, Agent, or Firm*—Lisa M. Soltis; Mark W. Croll; Josh C. Snider

(57) ABSTRACT

A gas combustion-powered apparatus includes a piston chamber housing a driveable piston, and a combustion chamber having a generally flat wall assembly and a cup-shaped wall defining at least one combustion volume therebetween. The cup-shaped wall is moveable in relation to the piston chamber, and has a generally flat portion opposing, and generally parallel to, the generally flat wall assembly. An ignition source is in operable relationship to the combustion volume, which can ignite a combustible gas within the combustion volume. The piston forms at least a portion of the generally flat wall assembly when the piston is in an undriven state.

27 Claims, 9 Drawing Sheets

U.S. PATENT DOCUMENTS

| | | | | |
|---|---|---|---|---|
| 5,181,495 | A | | 1/1993 | Gschwend et al. |
| 5,213,247 | A | | 5/1993 | Gschwend et al. |
| 5,680,980 | A | | 10/1997 | Robinson |
| 5,971,245 | A | | 10/1999 | Robinson |
| 6,102,270 | A | | 8/2000 | Robinson |
| 6,260,519 | B1 | | 7/2001 | Phillips |
| 6,419,168 | B1 | | 7/2002 | Thieleke et al. |
| 6,425,354 | B1 | | 7/2002 | Buchel et al. |
| 6,460,507 | B2 | | 10/2002 | Thieleke et al. |
| 6,463,894 | B2 | | 10/2002 | Hasler et al. |
| 6,505,767 | B2 | | 1/2003 | Thieleke et al. |
| 6,520,127 | B1 | | 2/2003 | Thieleke et al. |
| 6,526,926 | B1 | | 3/2003 | Towfighi |
| 6,755,335 | B2 | * | 6/2004 | Fielitz ..... 227/10 |
| 2003/0094148 | A1 | | 5/2003 | Toulouse |
| 2004/0164117 | A1 | * | 8/2004 | Nishikawa et al. |

* cited by examiner

COMBUSTION APPARATUS HAVING COLLAPSIBLE VOLUME

BACKGROUND OF THE INVENTION

The present invention relates to a gas combustion-powered apparatus, and more specifically to a gas combustion-powered fastener-driving apparatus having a collapsible combustion volume for displacing a gas volume within a combustion chamber.

Gas combustion devices are known in the art. A practical application of this technology is found in combustion-powered fastener driving tools. One type of such tools, also known as IMPULSE□ brand tools for use in driving fasteners into workpieces, is described in commonly assigned patents to Nikolich, U.S. Pat. Re. No. 32,452, and U.S. Pat. Nos. 4,522,162, 4,483,473, 4,483,474, 4,403,722, 5,197,646, and 5,263,439, all of which are incorporated by reference herein. Similar combustion powered nail and staple driving tools are available commercially from ITW-Paslode of Vernon Hills, Ill. under the IMPULSE□ brand.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and the engine also includes a reciprocating piston with an elongated, rigid driver blade disposed within a single cylinder body. When a work contact element is pressed against a workpiece, a fuel-metering valve introduces a specified volume of fuel into a combustion chamber of the engine.

Upon pulling a trigger switch, which causes the spark to ignite a charge of gas in the combustion chamber, the piston and the driver blade are shot downward to impact a positioned fastener and drive it into a workpiece. The piston then returns to its original, or "ready," position through differential gas pressures within the cylinder. Fasteners are fed magazine-style into a nosepiece, where the fasteners are held in a properly positioned orientation for receiving the impact of the driver blade. The charge of gas is a combustible fuel/air mixture, and the combustion in the chamber causes an acceleration of the piston/driver blade assembly and a resulting penetration of the fastener into the workpiece if the fastener is present in the nosepiece.

Combustion pressure in the chamber is an important consideration because such pressure affects the amount of force with which the piston may drive the fastener. Combustion pressure increases the more rapidly the fuel/air mixture within the combustion chamber can be ignited. The fuel/air mixture in the combustion chamber may be more rapidly ignited when the mixture is in a turbulent state. The ability to rapidly complete processes ancillary to this combustion operation of the tool is another important consideration. Such ancillary processes include: inserting the fuel into the combustion chamber; mixing the fuel and air within the chamber; and removing, or scavenging, combustion by-products remaining in the chamber after a combustion event.

One known method of scavenging the residual combustion by-products between combustion events is by dilution. Dilution scavenging is performed by sending fresh air flowing through the combustion chamber between combustion events to displace combustion by-products. An example of dilution scavenging is described in commonly assigned, copending application Ser. No. 10/170,736, which is incorporated by reference herein. A fan is located within the combustion chamber to create the turbulence for a more rapid, higher-energy combustion, and also to drive fresh air through the combustion chamber between combustion events. Although this process is effective to achieve rapid, high-energy combustions and scavenging, the scavenging is not always performed efficiently. Typically, a volume of air required to scavenge the combustion by-products after a combustion event is equal to approximately two and one half times the volume of the combustion chamber itself.

Another known method of scavenging, which is more efficient than the dilution method, is the displacement method. Displacement scavenging is performed by eliminating, or otherwise effectively reducing to zero, the volume within the combustion chamber itself, thereby removing all air within the volume, including that containing combustion by-products. Examples of displacement scavenging are described in patents to Cotta, U.S. Pat. No. 4,721,240, and to Gschwend, U.S. Pat. No. 5,181,495.

Cotta requires the displacement of moveable parts at the front of the combustion chamber toward a rear wall of the chamber. Displacement is thus performed by the movement of a second piston assembly through the combustion chamber in a direction opposite to the piston in the piston chamber. The second piston displaces the entire volume of gas from the combustion chamber, but does not actually reduce the volume to zero. Although reasonably efficient, the complexity of this configuration greatly increases the cost of the tool. The cost and complexity are both significantly increased by the number of extra components required for the second piston assembly, as well as a host additional electrical components (motors, batteries, control circuits, etc.) to operate the complex construction.

Gschwend displaces the combustion chamber volume by requiring that a moveable section at the rear of the combustion chamber move toward the front of the chamber to mostly collapse the chamber from behind, and reduce its volume to near zero. Force from an operator in back of the tool moves the moveable section to toward the front of the combustion chamber, thereby having the moveable section operate like Cotta's piston, but only in the reverse direction. Gschwend also separates the combustion chamber into first volume and a second combustion volume by use of a divider plate configured as a multiple-volume system, as is known in the art, to increase the energy of combustion.

To operate the tool as a multiple volume system though, Gschwend requires a complicated system of collapsing guide rods throughout the moveable section and the divider plate between the volumes. The tool's trigger also must be located at an awkward position at the rear of the tool where the operator must be positioned to push the moveable section toward the front of the tool, thereby making the tool itself cumbersome to operate. And similar to Cotta's tool as well, this tool is significantly complex, and requires a great deal of additional electrical and mechanical components to guide the opposing structures of the combustion chamber together and apart at appropriate timings.

There is a need therefore for a commercially available combustion gas fastener-driving tool having a simplified construction that reduces the need for expensive mechanical and electrical components in its construction. Such expensive components limit the availability of cordless combustion gas technology to a range of high cost applications only. A simplified single or multiple combustion volume construction, which can achieve substantially the same performance as the higher cost tools, would greatly extend the availability of combustion gas technology to more affordable, lower cost applications.

SUMMARY OF THE INVENTION

The above-listed concerns are addressed by the present gas combustion-powered apparatus, which features a simplified solid chamber structure for igniting a combustible gas to drive a piston. A combustion volume is defined between the piston and a moveable wall of a combustion chamber, and an ignition device ignites the combustible gas in or into the combustion volume to drive the piston. Turbulence is created within the combustion volume to increase the speed and energy of combustion in a single volume by either the movement of the moveable wall, or by a high speed fuel injected into the combustion chamber shortly prior to ignition, or in a second volume by a high speed flame jet exiting the first volume.

More specifically, the present invention provides a gas combustion-powered apparatus includes a driveable piston chamber housing a piston and a combustion chamber having a generally flat wall assembly and a cup-shaped wall defining at least one combustion volume therebetween. The cup-shaped wall is moveable in relation to the piston chamber, and has a generally flat portion opposing, and generally parallel to, the generally flat wall assembly. An ignition source is in operable relationship to the combustion volume, which can ignite a combustible gas within the combustion volume. The piston forms at least a portion of the generally flat wall assembly when the piston is in an undriven state.

In a gas combustion-powered apparatus, the simplified structure of the present invention is effective for generating high-energy combustion to drive a piston, and for a broader cost range of applications than other types of combustion-powered devices. The present invention is also effective in either single-, or multiple-volume combustion apparatuses.

DETAILED DESCRIPTION OF THE INVENTION

Figure 1:
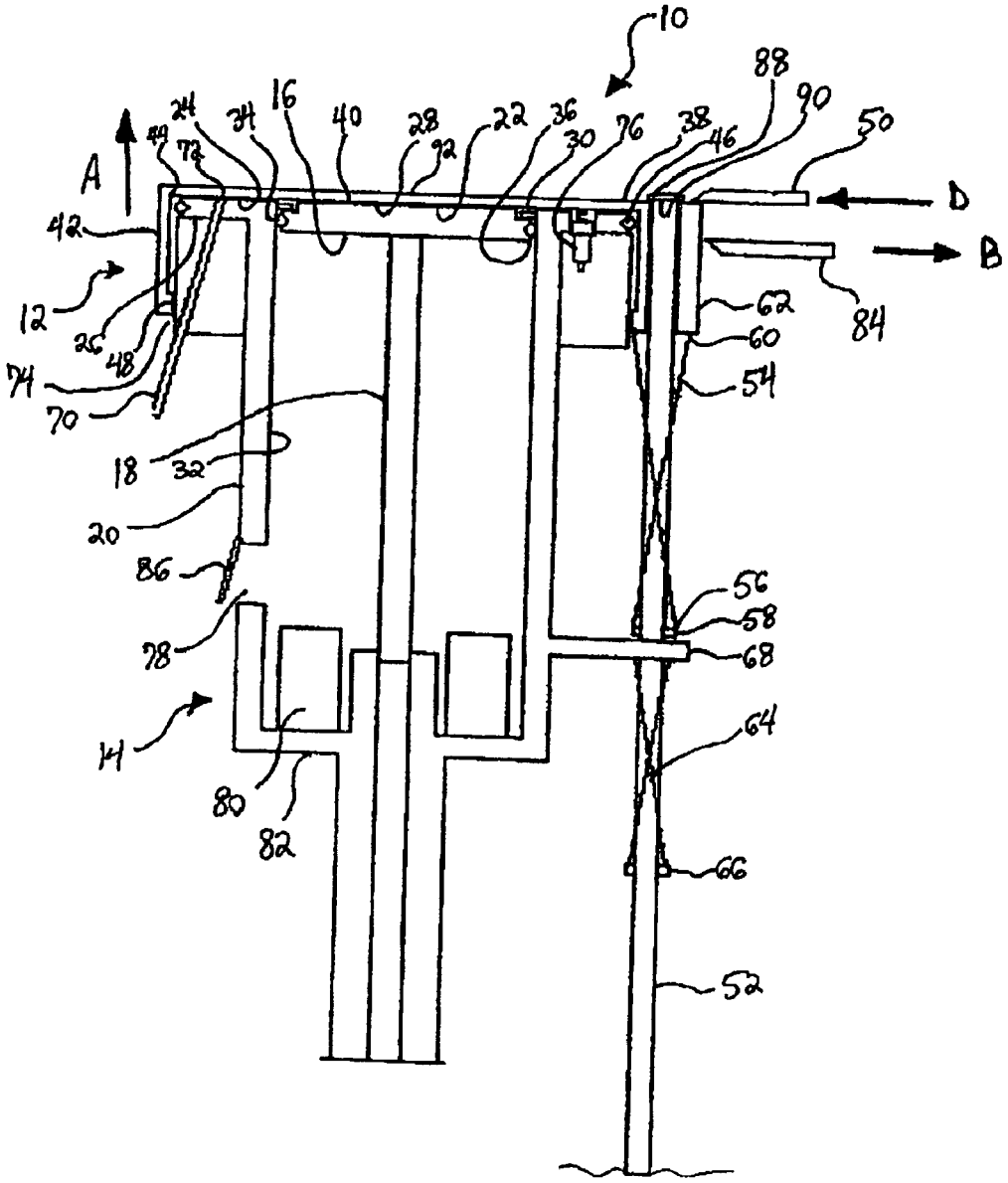
FIG. 1 is a vertical schematic sectional view of an embodiment of the present gas combustion-powered apparatus.

Referring now to FIGS. 1–4, a combustion-powered apparatus is generally designated 10, and includes a combustion chamber 12 in communication with a piston chamber 14. Such an apparatus 10 is preferably intended for use in a combustion-powered tool of the type described above and disclosed in the patents incorporated by reference herein. Both of the chambers 12 and 14 are preferably rigid metal bodies, but may also be formed from other strong, combustion-resistant solid materials as are known in the art. The piston chamber 14 houses a piston 16 and driver blade 18 within a main body 20, which is preferably generally cylindrical.

When the piston 16 is in a "ready" position prior to firing, as best seen in FIG. 1, a generally flat surface 22 of the piston substantially aligns with outer surface 24 of a flanged end 26 of the piston chamber 14 to create a substantially continuous and generally flat wall assembly 28. A piston stop 30, which is preferably one or more protrusions, or a continuous ring, around an inner surface 32 of the main body 20 of the piston chamber 14, is preferably positioned near the flange outer surface 24 against which the piston 16 aligns. Air is preferably prevented from flowing between the piston 16 and the piston chamber inner surface 32 by a piston seal 34. The piston seal is preferably an o-ring around an outer circumference 36 of the piston 16, but may also be any type of combustion-resistant seal known in the art.

Figure 3:
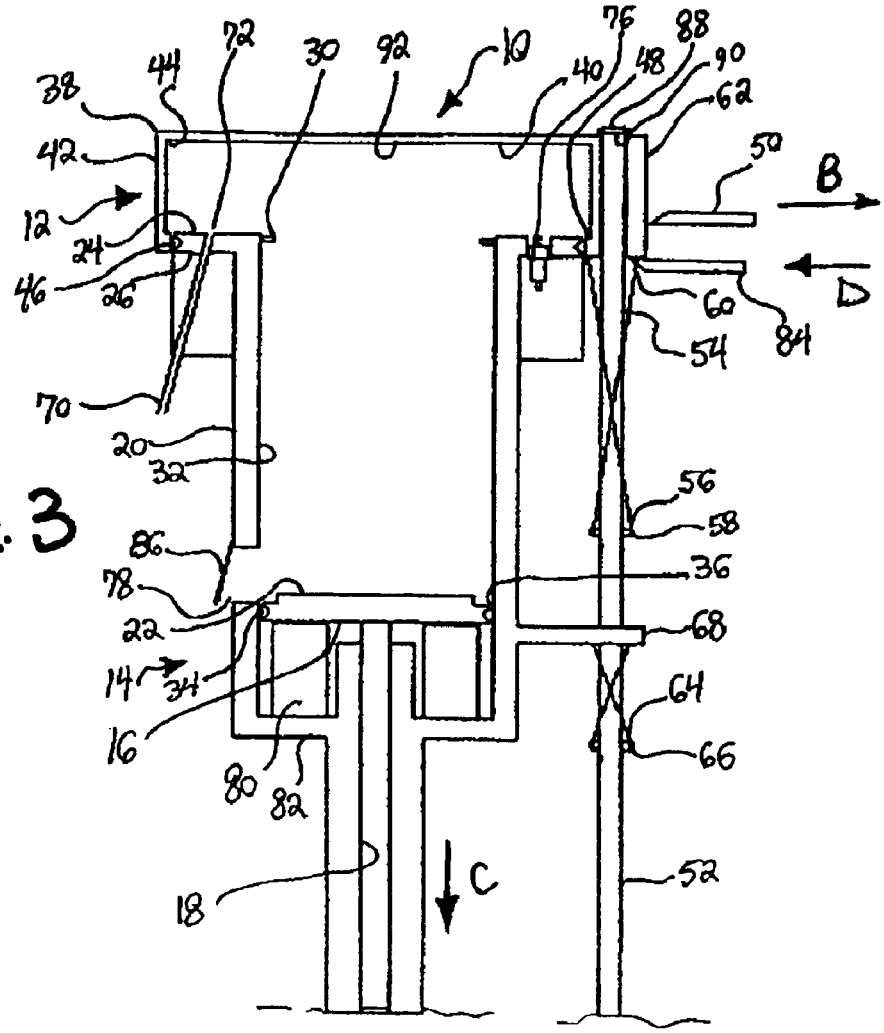
FIG. 3 is a partial sectional schematic view of the apparatus shown in FIG. 1.

The flat wall assembly 28, together with a cup-shaped wall 38, defines the combustion chamber 12. Referring now to FIG. 1, the combustion chamber 12 is shown in a fully closed, or "collapsed," position. The cup-shaped wall 38 includes a generally flat rear surface 40 that opposes, and is generally parallel to, the flat wall assembly 28, and a continuous sleeve body 42 joining to an outer periphery 44 of the flat rear surface. The cup-shaped wall 38 is preferably formed as single piece, or as several pieces solidly joined together, and is slidingly moveable in a direction A about the piston chamber flanged end 26. A chamber seal 46 preferably prevents air from flowing between the flanged end 26 and an internally extending portion 48 of the sleeve body 42 when the cup-shaped wall 38 is in a fully opened position, as best seen in FIG. 3. The sleeve body 42 is preferably cylindrical, but may be of any shape to conform to a shape of the flanged end 26, and the flat rear surface 40.

Although moveable, the cup-shaped wall 38 is preferably held in the fully closed position by a first pawl 50. The first pawl 50 is configured as well known in the art to be preferably located directly, or by a linkage, in association with a housing (not shown) of the tools described above. The first pawl 50 is preferably also a beveled rod, or any solid shape known in the art which is moveable to hold the cup-shaped wall 38 firmly. When in the fully closed position, the flat rear surface 40 of the cup-shaped wall 38 approaches very near to, or contacts, the flat wall assembly 28, which includes the flange outer surface 24 and the piston flat surface 22. When the cup-shaped wall 38 is in the fully closed position therefore, there is preferably no effective volume of air between the flat rear surface 40 and the flat wall assembly 28.

Figure 2:
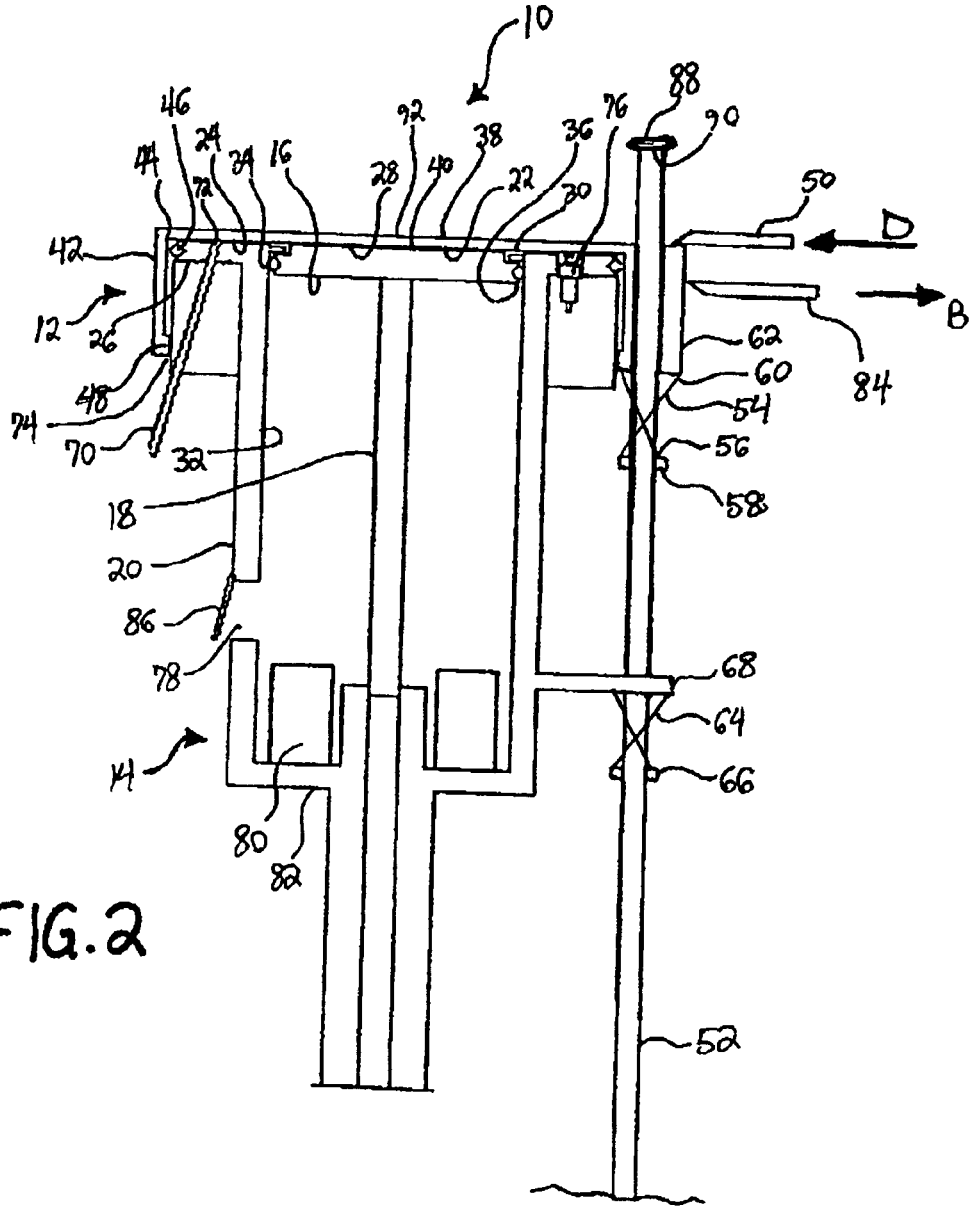
FIG. 2 is vertical schematic sectional view illustrating an operation of the apparatus shown in FIG. 1.

Referring now to FIG. 2, a work contact element 52 is pressed against a workpiece (not shown), pushing the work contact element in the direction A. The work contact element 52 is connected directly to the cup-shaped wall 38, but is more preferably operably linked to the cup-shaped wall by a first spring 54. A first end 56 of the first spring 54 is connected to a first stop 58 located on the work contact element 52, and a second end 60 of the first spring is connected to an extending portion 62 of the cup-shaped wall 38. The movement of the work contact element 52 and the first stop 58 in the direction A compresses the first spring 54 to create pressure against the cup-shaped wall 38, which is still held in place by the first pawl 50. A second spring 64 is similarly compressed between a second stop 66 and an extending portion 68 of the piston chamber 14. The compression of the second spring 64 moves the work contact element 52 back to its original ready position when released from the workpiece. The extending portion 68 also preferably serves as a guide for the moving work contact element 52.

Referring now to FIG. 3, when a trigger (not shown) is activated, the pawl 50 retracts in the direction B, thereby allowing the pressure from the compressed first spring 54 to rapidly move the cup-shaped wall 38 in the direction A to the fully opened position, thereby creating a combustion volume between the flat wall assembly 28 and the open cup-shaped wall. In this embodiment, fuel is preferably injected from a fuel line 70 into the combustion volume through a fuel port 72 when the trigger releases the first pawl 50. However, fuel may also be injected at any time while the flat wall assembly 28 and the rear surface 40 of the cup-shaped wall are still moving apart. A suitable fuel is MAPP gas of the type used in combustion-powered fastener driving tools, but may also be any of a number of known combustible fuels practiced in the art. As the cup-shaped wall 38 moves in the direction A, a vacuum pressure from the opening combustion volume draws air into the combustion chamber 12 along and through an unsealed periphery 74 between the cup-shaped wall 38 and the piston chamber 14. The vacuum pressure also facilitates holding of the piston 16 against the piston stop 30.

The rapid movement of the cup-shaped wall 38 toward the fully opened position creates turbulence within the combustion chamber 12 and the opening combustion volume therein. The turbulence in turn mixes the fuel and the air in the volume. Ideally, when the cup-shaped moving wall 38 reaches its fully opened position, but before the turbulence with the volume subsides, an ignition source 76 (which is preferably a spark plug) ignites the turbulent air/fuel mixture within the combustion chamber 12. The turbulence within the combustion chamber 12 also increases the speed at which the air/fuel mixture ignites, thereby also increasing the combustion pressure. The rapid increase in combustion pressure drives the piston 16 in the direction C, which in turn drives the driver blade 18 to drive the fastener into the workpiece.

Excess combustion pressure in the piston chamber 14 is expelled through an exhaust port 78, and the piston 16 comes to a stop against a resilient member 80 after the piston passes the exhaust port in the direction C. Although the resilient member 80 is preferred to act as a brake for the piston 16, air pressure between the piston and a generally closed end 82 of the piston chamber 14 may also be utilized to provide a braking force for the piston. Additionally, when the cup-shaped wall 38 reaches its fully opened position, by a linkage with the tool housing and trigger (not shown) similar to that of the first pawl 50, a second pawl 84 moves in the direction D to contact the cup-shaped wall and fixedly hold it in the fully opened position, and thus also fixedly sealing the piston chamber flanged end 26 to the internally extending sleeve portion 48 at the chamber seal 46.

As residual gas within the combustion chamber 12 and the piston chamber 14 cools, a vacuum develops in the chambers, which closes a valve 86 over the exhaust port 78, and draws the piston 16 back to the initial ready position aligning with the flange outer surface 24 (FIG. 1). When the trigger is released, the second pawl 84 retracts in the direction B, thereby allowing the vacuum to also pull the cup-shaped wall 38 toward its initial fully closed position. As the cup-shaped wall 38 closes, the volume within the combustion chamber 12 is effectively reduced to zero, and all of the residual combustion gases from the volume are expelled through the unsealed periphery 74 (FIG. 1). Additionally, force from the compressed second spring 64 causes a catch 88 on an end 90 of the work contact element 52 to pull the cup-shaped wall 38 toward the initial fully closed position after the second pawl 84 retracts, and after the work contact element is removed from the workpiece.

Figure 4:
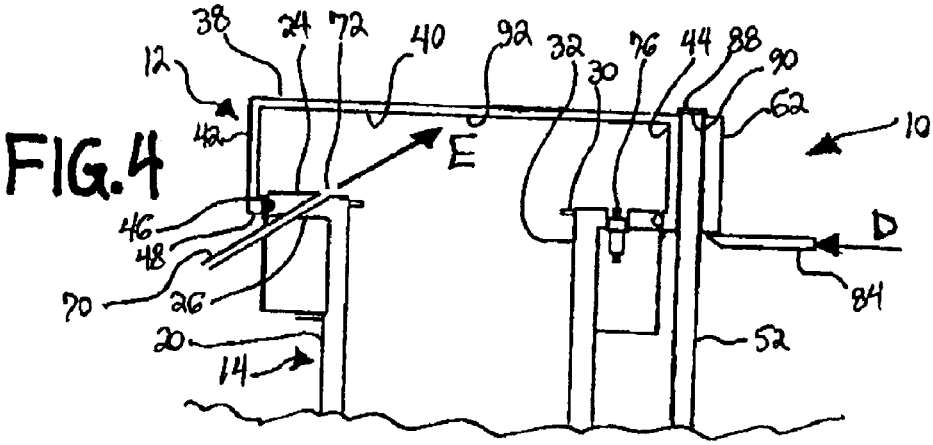
FIG. 4 illustrates an alternative configuration of the apparatus illustrated in FIG. 1.

Referring now to FIG. 4, an alternative configuration of the apparatus 10 is configured without the first pawl 50. This alternative configuration is otherwise identical to the configuration shown in FIG. 1, except for the positioning of the fuel line 70 and fuel port 72 along the flanged end 26 of the piston chamber 14. According to this configuration, the turbulence in the combustion chamber 12 is created by injecting the fuel into the combustion volume as a high-speed fuel jet. The present inventors have discovered that, when properly configured within the combustion volume, the high-speed fuel jet will have sufficient energy to create the necessary turbulence to produce a rapid, high-energy combustion. The fuel jet itself thus serves as the mixing element for the fuel and the air. The air still is drawn into the combustion chamber 12 through the unsealed periphery 74 as the cup-shaped wall 38 is pushed open. Mixing occurs as the air is entrained into the jet as the jet courses through the open combustion chamber 12.

To maximize the mixing effect, the fuel line 70 and fuel port 72 should be positioned at the flanged end 26 of the piston chamber 14 to fire the jet of fuel in a direction E toward the flat rear surface 40 of opened cup-shaped wall 38, and more preferably toward a center point 92 of the flat rear surface. The ignition source 76 should also be located ideally on the flanged end 26, and generally in the same plane as the fuel port 72 and the piston surface 22, but at a maximum distance from the fuel port along the flanged end. By this preferred configuration, the fuel jet travels a maximum distance from the fuel port 72 toward the center 92 of the rear surface 40, and then toward the ignition source 76 before igniting. This extended distance allows for better mixing of the fuel with air in the combustion volume.

Also according to this configuration, the first spring 54 is preferably eliminated, and the cup-shaped wall 38 can be directly fixed to the work contact element 52, thereby moving to the fully opened position directly when the work contact element is placed against the workpiece. The fuel need not be injected when the combustion chamber 12 opens, but instead is preferably introduced into the already-open chamber whenever firing is desired. Ideally then, when the trigger is activated, the second pawl 84 moves in the direction D to lock the cup-shaped wall 38 into the fully opened position, as described above (FIG. 3), the fuel jet is injected into the combustion volume, and the ignition source 76 ignites the resultant fuel/air mixture. The ignition source 76 is preferably timed to allow the fuel jet sufficient time to travel across the combustion volume before ignition occurs. The remaining sequence of operation for this alternative configuration is as described above for FIGS. 1–3.

According to these embodiments of the present invention, a combustion volume is created from a simplified construction of an expanding collapsible chamber by moving apart two generally opposing walls of the chamber. Turbulence for a rapid combustion is thus created by one of two methods described above. According to the first method, components of the chamber move apart immediately prior to igniting the fuel/air mixture, to expand the combustion volume. The turbulence created by the moving components is adequate to produce the rapid combustion needed for a practical tool if ignition occurs early enough. According to the second method though, a fuel jet both creates the turbulence, and also is the mixing element for the air and fuel. Both turbulence generation methods produce adequate fuel/air mixtures for rapid, high-energy combustions.

Referring now to FIGS. 5–8, a combustion-powered apparatus is generally designated 100, but features of the apparatus 100 that are the same as those described above with reference to FIGS. 1–4 are identified by the same numerical designations.

The apparatus 100 includes a combustion chamber 102 in communication with a piston chamber 104, and is formed of materials as described above with respect to the apparatus 10. The piston chamber 104 is preferably cylindrical, and is located partially within the combustion chamber 102, which is also preferably cylindrical and has a larger outer diameter than the piston chamber, however, non-cylindrical shapes are also contemplated. A moveable plug 106 is located within the combustion chamber 102. In this embodiment, the combustion chamber 102 is preferably a rigid structure, and does not move relative to the piston chamber 104.

Figure 7:
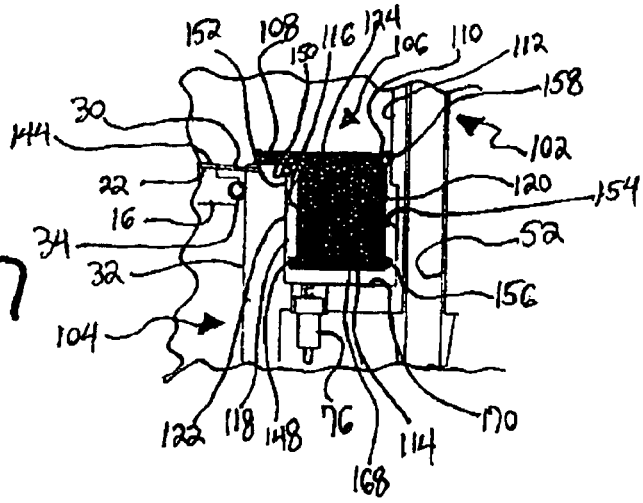
FIG. 7 is an expanded partial sectional view illustrating the moveable plug structure of the embodiment shown in FIG. 5.

The moveable plug 106 includes a generally flat base portion 108, which preferably is shaped as a round disk having an outer periphery 110, which generally corresponds to an inner wall 112 of the combustion chamber 102. Connected to the base portion 108 is a generally ring-shaped wall 114, which has a ring inner wall 116 that preferably corresponds to an outer wall 118 of the piston chamber 104, and a ring outer wall 120 that generally corresponds to the inner wall 112 of the combustion chamber 102. As best seen in FIG. 7, the ring-shaped wall 114 has a height H that preferably corresponds to a length L of a portion 122 of the piston chamber 104 which is located within the combustion chamber 102. In this embodiment, the flat base portion 108 and the ring-shaped wall 114 together preferably form a cup shape similar to the cup-shaped wall 38 of the apparatus 10 (FIGS. 1–4). The cup-shaped portion 108, 114 of the plug 106 therefore functions, with respect to the portion 122 of the piston chamber 104, similarly to the function of the cup-shaped wall 38 with respect to the piston chamber 14 of the apparatus 10 (FIGS. 1–4).

Connected to the base portion 108, and on a side 124 of the base portion opposite to the ring-shaped wall 114, is a stem portion 126. The stem portion 126 is preferably centered relative to the base portion 108, and preferably generally aligns with the driver blade 18 of the piston 16. The stem portion preferably extends through an opening 128 in a rear wall 130 of the combustion chamber 102, and is fixedly attached to an attaching member 132, which in turn is operably linked to the work contact element 52 directly, by spring tension, or other linking methods known in the art. Although the moveable plug 106 is preferably formed from separate and/or hollow pieces, the base portion 108, the ring-shaped wall 114, and the stem portion 126 are more preferably formed together as a single, solid piece, and of generally rigid, combustion-resistant materials as are known in the art.

Figure 5:
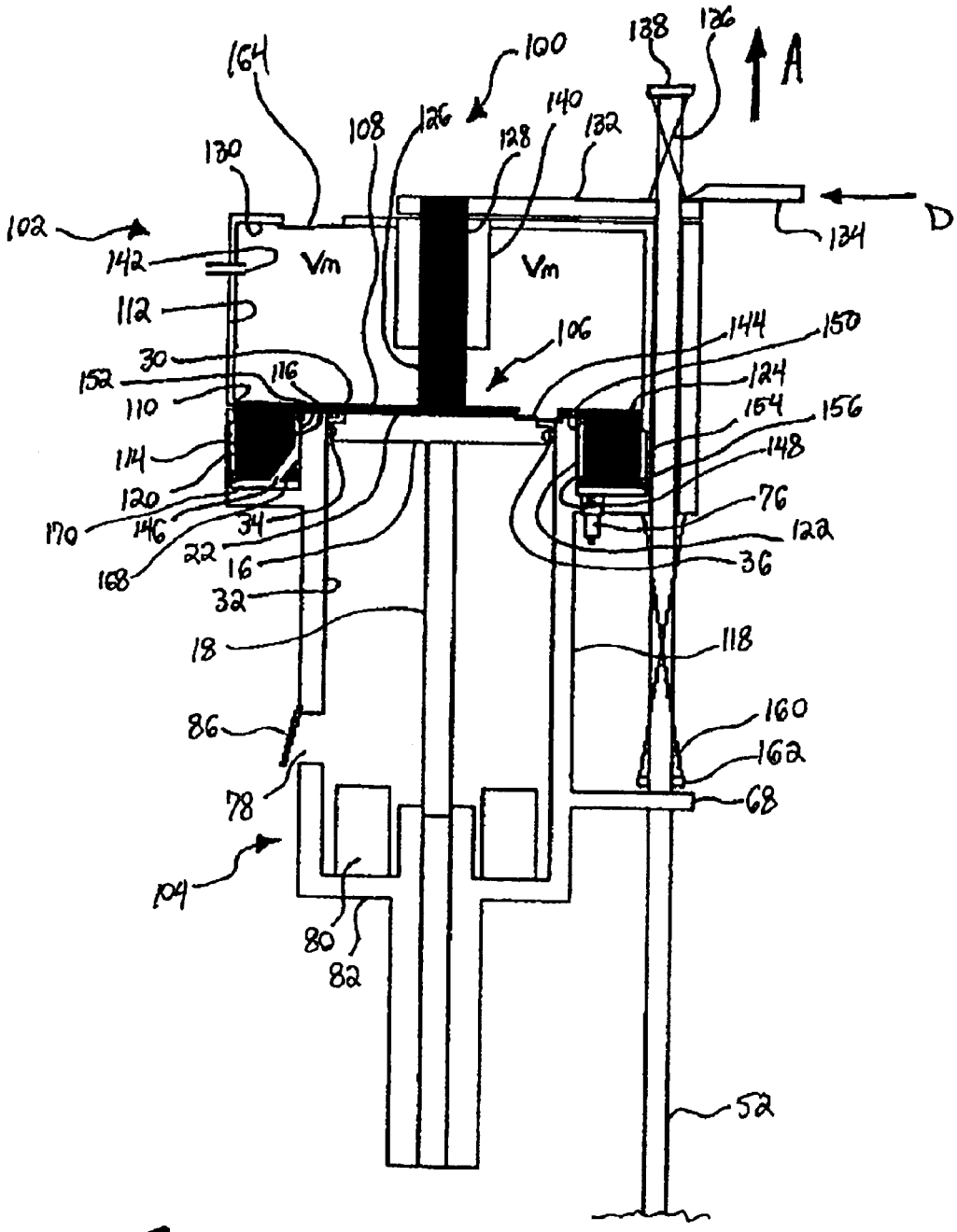
FIG. 5 is a vertical schematic sectional view of another embodiment of the present gas combustion-powered apparatus.

The base portion 108 and the ring-shaped wall 114 have a cup-like shape, and move and function in relation to the piston chamber 104 similarly to the way the cup-shaped wall 38 moves and functions in relation to the piston chamber 14 of the apparatus 10, as described above. As best seen in FIG. 5, the moveable plug 106 is fixedly held in the fully closed, or ready, position by a pawl 134, which is associated or linked with a tool housing (not shown) similar to the pawls 50, 84 described above. In this embodiment, when the moveable plug 106 is fully closed, a single mixing volume Vm is defined within the combustion chamber 102 between the side 124 of the base portion 108 and the rear wall 130 of the combustion chamber. All other volume of air within the combustion chamber 102, but outside of the dimensions of the mixing volume Vm, is effectively reduced to zero. As the work contact element 52 is pushed against the workpiece, a first spring 136, which connects the attaching member 132 to the work contact element at a first spring stop 138, is stretched to create a pulling tension against the attaching member in the direction A.

Figure 6:
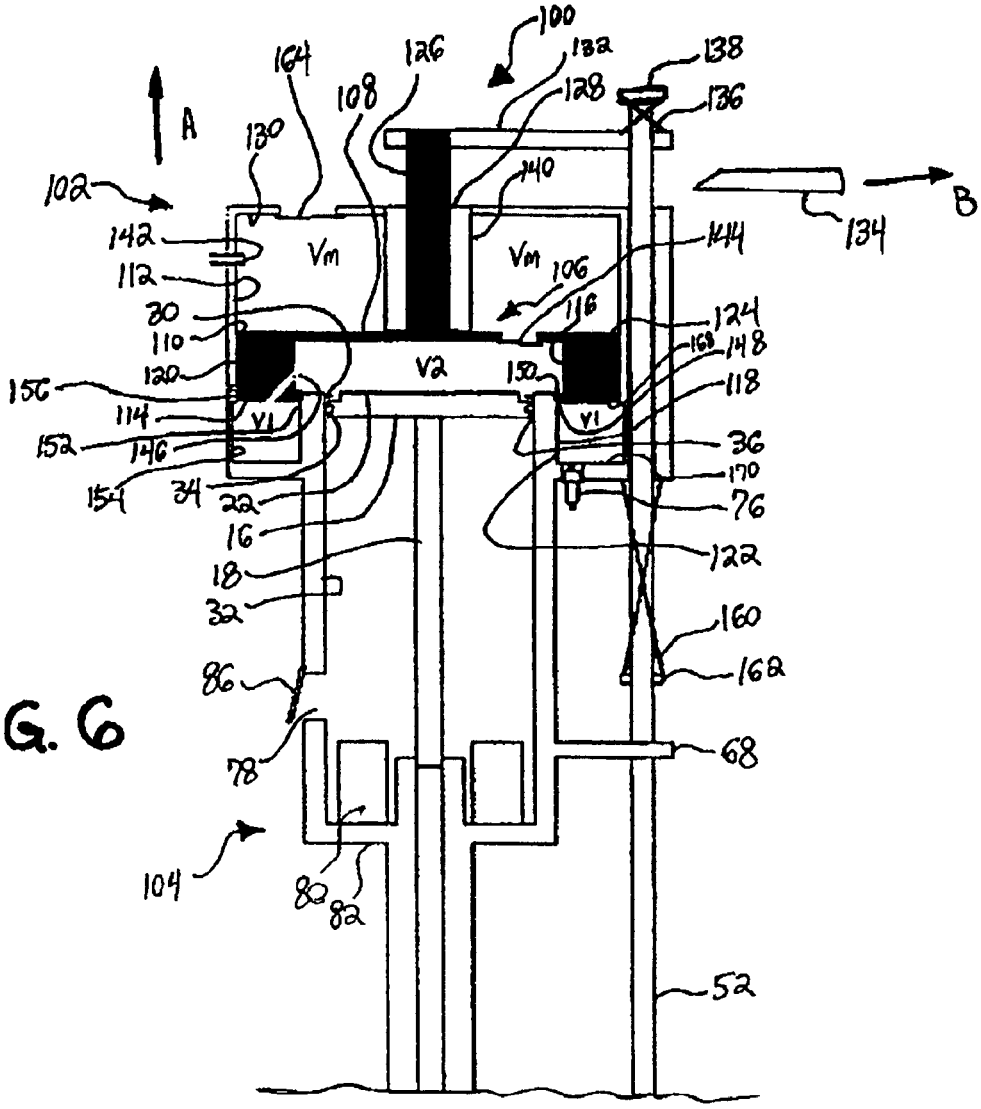
FIG. 6 is vertical schematic sectional view illustrating an operation of the apparatus shown in FIG. 5.

Referring now to FIG. 6, activation of the trigger releases the pawl 134 in the direction B, and the pulling tension from the first spring 136 rapidly moves the plug 106 in the A direction toward the rear wall 130 of the combustion chamber 102. This movement of the plug 106 is preferably terminated when the side 124 of the base portion 108 contacts a resilient stop 140 at the fully open position of the plug. In addition to acting as a brake for the movement of the plug 106, the resilient stop 140 is preferably a hollow cylinder, which also preferably serves as a guide for the movement of the stem portion 126 through the hollow cylinder, as well as a seal against potential airflow into the mixing volume Vm through the opening 128. When the moveable plug 106 reaches its fully open position, the mixing volume Vm partially collapses, and first and second combustion volumes V1 and V2 respectively are created within the combustion chamber 102, which now contains at least three separate and distinct volumes.

When the plug 106 is fully open, the first and second combustion volumes V1 and V2 together contain approximately the amount of volume by which the mixing volume Vm is reduced. In other words, the distinct volumes within the combustion chamber 102 preferably generally satisfy the equation $V1+V2+Vm_{open}=Vm_{closed}$. Although the mixing volume Vm is not entirely collapsed in this configuration, the present inventors contemplate that the moveable plug 106 and chambers 102, 104 are configurable so that the resilient stop 140 is alternatively removed, and the base portion 108 then will open all of the way to the rear wall 130 of the combustion chamber 102. The formula described above would then still be satisfied as $Vm_{open}$ becomes equal to zero.

The first combustion volume V1 is preferably annular, and the second combustion volume V2 is cylindrical. A diameter of the cylindrical volume V2 will then preferably be approximately equal to an inner diameter of the annular volume V1. The cylindrical volume V2 also ideally conforms to the shape of the cylindrical portion 122 of the piston chamber 104 located within the combustion chamber 102. The mixing volume Vm is basically cylindrical, but can also be considered annular when movement of the plug 106 is effected by the central inclusion of the stem portion 126 through the mixing volume Vm. One skilled in the art, however, will be aware that movement of the plug 106 may instead be operably linked to the movement of the work contact element 52, without the inclusion of the stem portion 126, through many other linkage methods known in the art, without departing from the present invention.

As best seen in FIG. 5, when the work contact element 52 is pressed against the workpiece, fuel is preferably injected into the mixing volume Vm of the combustion chamber 102 through a first fuel port 142, to mix with air in the mixing volume. Although fuel is preferably injected at this time, it can also be injected at any time prior to movement of the moveable plug, such as in coordination with an activation of the trigger. As described above, the trigger activation will also preferably move the pawl 134 in the direction B to release the attaching member 132 to begin a rapid movement of the moveable plug in the direction A.

Referring now to FIG. 6, as the first combustion volume V1 and the second combustion volume V2 begin to open and expand, the fuel/air mixture in the mixing volume Vm is drawn into the combustion volume V2 through a fuel valve 144 located in the base portion 108, and then from the combustion volume V2 into the combustion volume V1 through at least one combustion port 146 located in the ring-shaped wall 114. The fuel valve 144 is preferably a reed valve, but may be any type of valve known in the art which allows one-way communication from the mixing volume Vm into the combustion volume V2. The combustion port 146 is ideally located on the ring-shaped wall 114 at a location that is a maximum distance on the wall 114 from the ignition source 76. Vacuum pressure, caused by the expansion of the combustion volumes V1 and V2, will then fill the two combustion volumes with the fuel/air mixture. The vacuum and rapid expansion of the combustion volumes V1 and V2 will also create a sufficient turbulence within both of the combustion volumes V1 and V2 to provide a rapid, high-energy combustion when the fuel/air mixture is ignited.

Referring now to FIG. 7, the chambers 102, 104 and the ring-shaped wall 114 are configurable to allow even greater airflow between the several volumes within the combustion chamber, to provide additional filling, mixing, and turbulent properties to the several volumes. The ring-shaped wall 114 is preferably formed to include an extending portion 148 on the ring inner wall 116 which approaches, but does not contact, the portion 122 of the piston chamber 104 inside the combustion chamber 102. In this preferred configuration, when the plug 106 reaches the fully opened position, the extending portion 148 will contact a combustion seal 150, thereby sealing airflow between the two combustion volumes V1 and V2, except for the combustion port 146. The combustion seal 150 is preferably an o-ring located around an outermost periphery 152 of the piston chamber portion 122, but may be any type of combustion-resistant seal known in the art. The air/fuel mixture in the second combustion chamber V2 then flows around the combustion seal 150 and across the ring inner wall 116 into the first combustion chamber V1 while the plug 106 is moving, but is blocked when the plug reaches the fully opened position. This increased airflow further increases turbulence in the first combustion volume V1 shortly prior to ignition.

To further increase the turbulence in V1 caused by the structure of the moving plug 106, a recess 154 is preferably provided on the inner wall 112 of the combustion chamber 102, and located in the vicinity of the ring-shaped wall 114 when the plug 106 is in the fully closed position. The recess 154 thus allows additional airflow between the combustion chamber inner wall 112 and the outer wall 120 of the ring-shaped wall 114. A first ring seal 156 is preferably located on the ring outer wall 120 opposite to the extending portion 148 of the ring inner wall 116. Airflow is then sealed between the ring outer wall and the combustion chamber inner wall 112 when the first ring seal 156 moves past the recess 154 and the plug 106 reaches the fully opened position.

Before the first ring seal 156 passes the vicinity of the recess 154, however, the ring outer wall 120 and the combustion chamber inner wall 112 are configurable to allow additional airflow between the mixing volume Vm and the first combustion volume V1 while the plug 106 is moving, but before first ring seal contacts the combustion chamber inner wall. A second ring seal 158 is optionally included on the ring outer wall 120, and near the base portion 108, to prevent any direct airflow between the mixing volume Vm and the first combustion volume V1 by having the second ring seal be always in contact with the combustion chamber inner wall 112 away from the recess 154, and regardless of whether the plug 106 is in the fully opened or fully closed positions. The present inventors contemplate that it may desirable in some circumstances to prevent direct airflow into the first combustion volume V1 from the mixing volume Vm.

Referring now to FIG. 6, activation of the trigger causes the pawl 134 to move in the direction B, thereby allowing the plug 106 to rapidly move in the direction A. The moving plug 106 reduces the mixing volume Vm and opens first and second combustion volumes V1 and V2 respectively. The fuel/air mixture in the mixing volume Vm flows into combustion volumes V1 and V2, and a spark from the ignition source 76 ignites the fuel/air mixture in the first combustion volume V1, and preferably when the plug 106 reaches the fully opened position and turbulence within the combustion volume V1 still exists from the movement of the plug. A flame front of the ignited fuel/air mixture then progresses through dual arcs of the annular combustion volume V1, until reaching combustion port 126. The moving flame front passes through the combustion port 126 and into the second combustion volume V2 as an ignited gas jet, thereby also igniting the fuel/air mixture within the volume V2. The ignited gas jet also creates turbulence in the volume V2, and in addition to the turbulence caused by movement of the plug 106.

As the air/fuel mixture in the second combustion volume V2 is ignited, the increased pressure in the volume V2 rapidly pushes the piston 16 and driver blade 18 to drive the fastener into the workpiece. Similarly to the operation of the apparatus 10 described above, excess pressure in the piston chamber 104 is exhausted through the exhaust port 78 as and after the piston 16 passes the exhaust port. As the gas remaining within the piston chamber 104 and combustion volumes V1 and V2 cools, a vacuum develops which acts to pull the piston 16 back to the initial ready position. When the tool 100 is removed from the workpiece, the work contact element 52 is returned to its original ready position as well by compression force of a second spring 160, which is ideally compressed between a second spring stop 162 located on the work contact element 52, and either of the combustion chamber 102 or the piston chamber 104.

The combination of the return movement of the work contact element 52 to its ready position, together with the vacuum created in the combustion volumes V1 and V2 from the cooling gas, causes the plug 106 to move to its original closed position, thereby collapsing both of the combustion volumes V1 and V2, while also effectively scavenging the remaining combustion gases from both combustion volumes as well. The movement of the plug 106 to its fully closed position also reduces the pressure in the mixing volume Vm, which in turn draws fresh air into the volume Vm through an air check valve 164. The air check valve 164 is preferably a reed valve, but can be any combustion-resistant one-way valve as is known in the art. When the trigger is released, the pawl 134 moves in the direction D to lock the attaching member 132 near the combustion chamber 102 (FIG. 5), in preparation for a next combustion/firing cycle.

Figure 9:
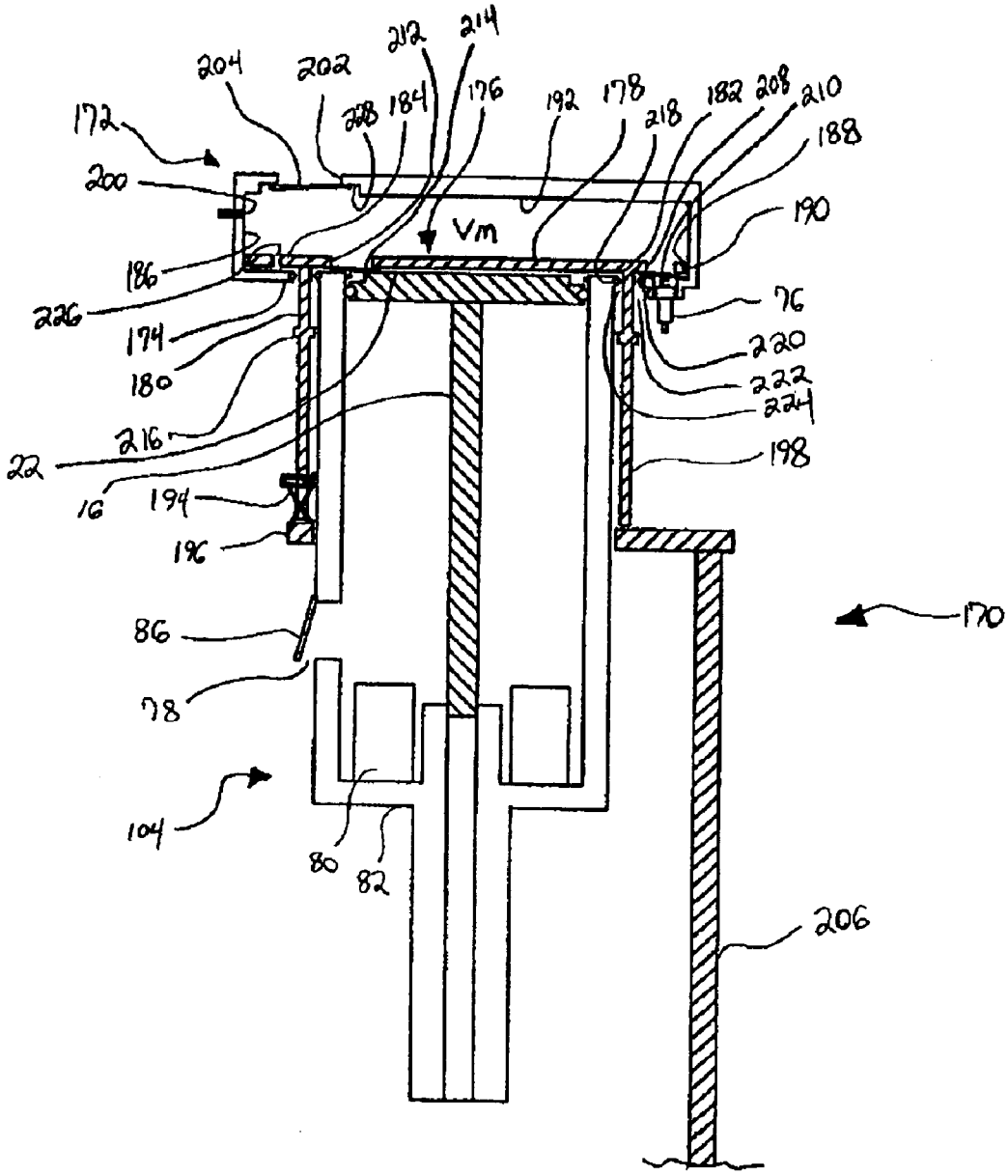
FIG. 9 is a vertical schematic sectional view of still another embodiment of the present gas combustion-powered apparatus.
Figure 10:
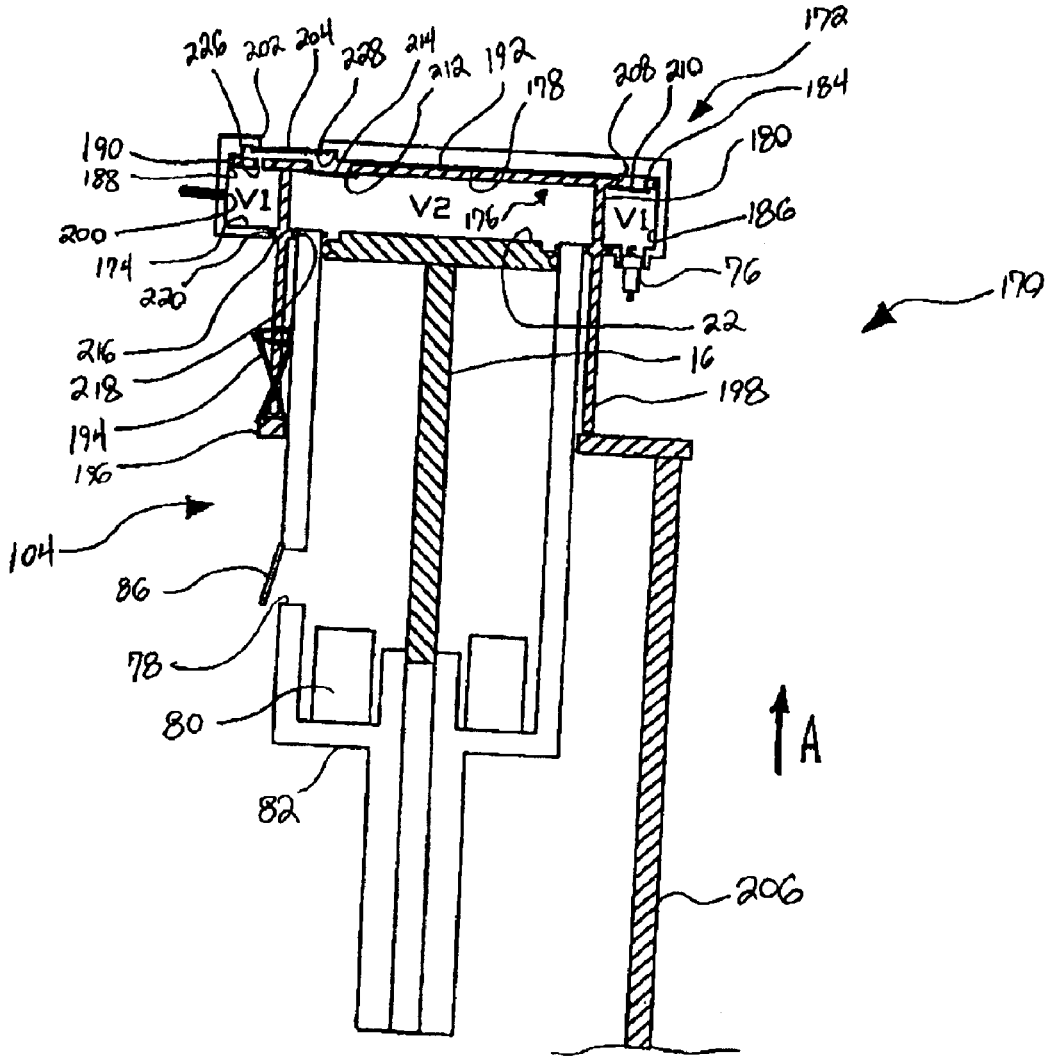
FIG. 10 illustrates an operation of the apparatus illustrated in FIG. 9.
Figure 11:
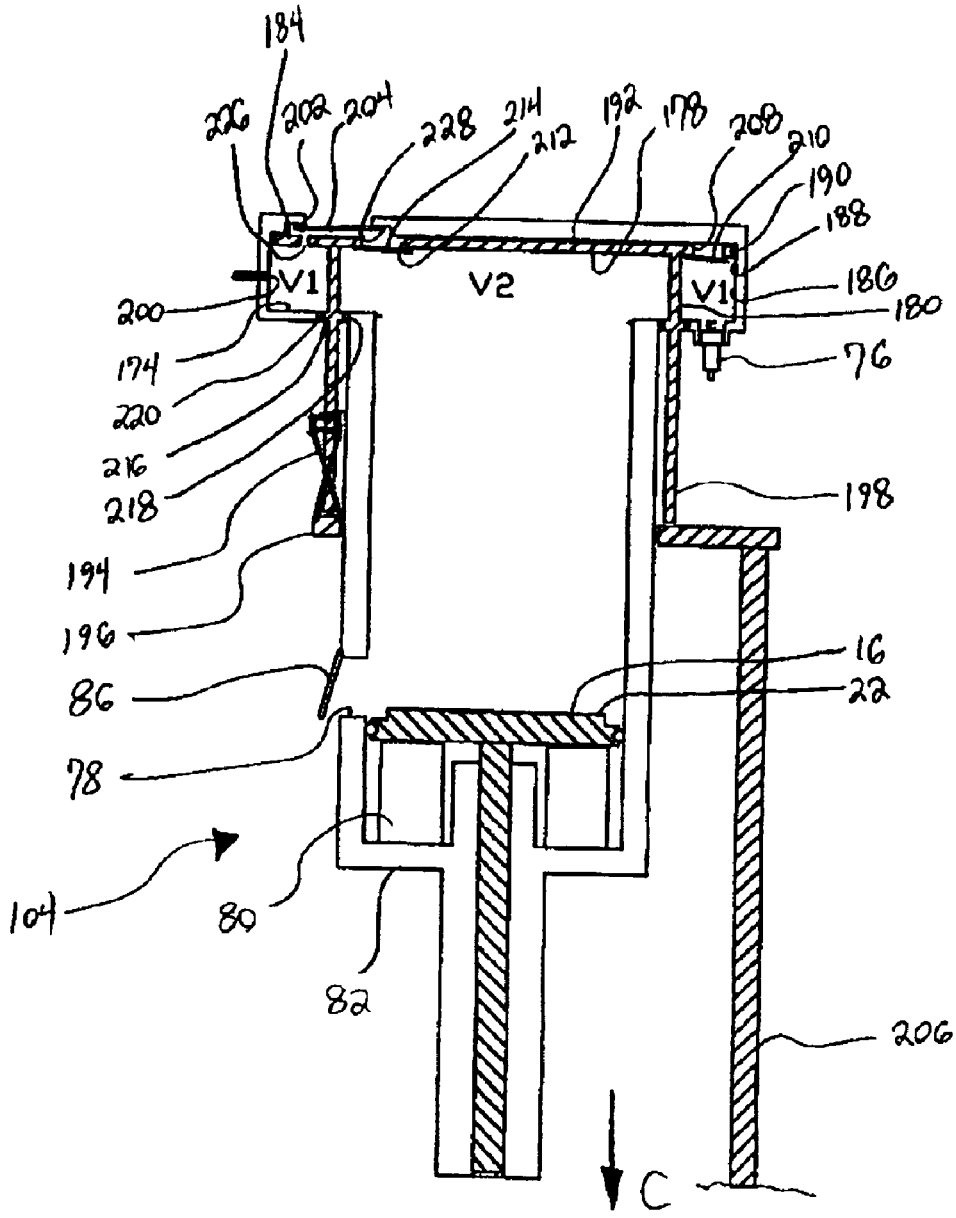
FIG. 11 illustrates a further operation of the apparatus illustrated in FIG. 9.

Because the mixing volume Vm is not utilized in the actual combustion (the air/fuel mixture in the volume Vm is not ignited), it is not an important consideration for combustion purposes to displace the entire volume Vm, or scavenge its unignited contents. The present inventors do contemplate, however, that other considerations may make it desirable to completely displace the mixing volume Vm (FIGS. 9–11, below). The present inventors also contemplate that it may be preferable in some circumstances to inject the fuel into the mixing chamber Vm at this time (trigger release), which will also be in preparation for the next cycle.

Figure 8:
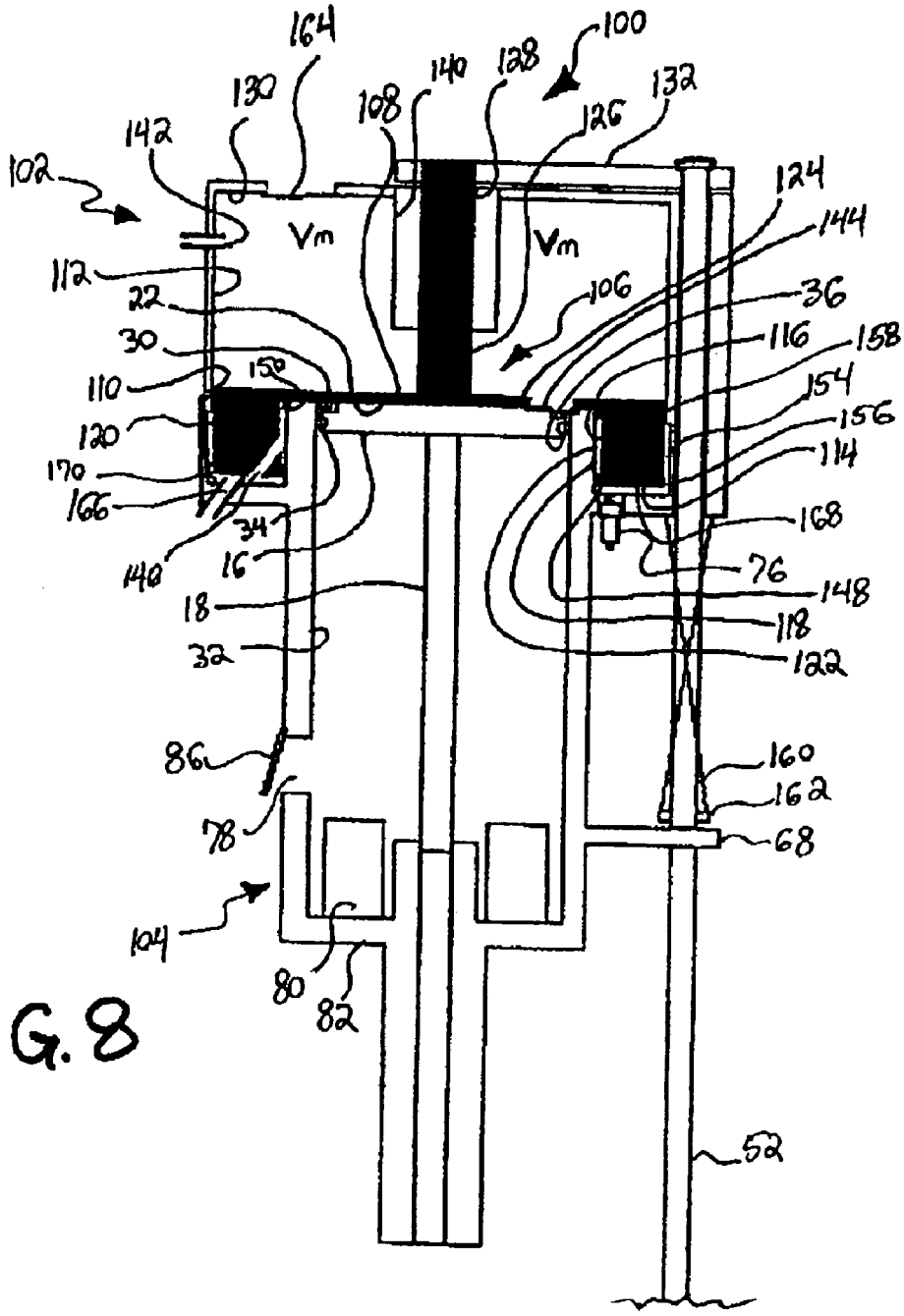
FIG. 8 is an alternative configuration of the apparatus illustrated in FIG. 5.

Referring now to FIG. 8, an alternative configuration of the apparatus 100 uses a fuel jet, similar to that described above for the tool 10 (FIG. 4), to generate turbulence in the combustion volume V1 immediately prior to ignition. The present inventors have discovered that, for this configuration, only a moderate amount of turbulence is required in the first combustion volume V1 to rapidly and sufficiently ignite the air/fuel mixture drawn into the volume. A second fuel port 166 is preferably located along the combustion chamber 102, to allow a high-speed fuel jet to be injected directly into the first combustion volume V1. The second fuel port 166 is preferably located on the combustion chamber 102 in the same plane as, but at a maximum distance from, the ignition source 76, to allow a maximum amount of mixing of air and gas throughout the volume V1 before the fuel/air mixture reaches the ignition source. Except for the addition of the second fuel port 166, and the elimination of the pawl 134 and the spring 136, this alternative configuration is preferably the same as that shown in FIGS. 5–7.

For this configuration, the attaching member 132 is connected directly to the work contact element 52, thereby opening the first and second combustion volumes to the fully opened position when the work contact element 52 is pressed against the workpiece. For this particular configuration then, the fuel jet is preferably injected upon activation of the trigger, and the ignition source 76 is timed to spark after a brief delay to allow the air and fuel to fill and mix in both combustion volumes. The air/fuel mixture enters the second combustion volume V2 through the combustion port 146 from the first combustion volume V1, or through the fuel valve 144 from the mixing volume Vm, or both.

When the mixing volume Vm is used as an air/fuel mixture source for the second combustion volume V2, fuel is preferably injected into the mixing volume Vm through the first fuel port 142, when the work contact element 52 opens the plug 106 to the fully opened position. The present inventors also contemplate, however, that because no fuel is actually required in the mixing chamber Vm for combustion, the first fuel port 142 may be entirely eliminated from the structure, leaving the mixing volume Vm as a source for fresh air only into the combustion volumes V1, V2, and the second fuel port 166 as the only fuel source for the three volumes. In this configuration, it is also preferable to eliminate the second ring seal 158 from the structure in order to allow direct airflow between the mixing volume Vm and the first combustion volume V1 while the combustion volume V1 is expanding.

For this configuration, the first combustion volume V1, into which the fuel is injected, is defined between a preferably flat portion 168 of the ring-shaped wall 114 and an opposing region 170 of the combustion chamber 102. The flat portion 168 is preferably generally parallel to both the base portion 108 and the opposing region 170, and located on an end of the ring-shaped wall 114 opposite to the base portion 108. The opposing region 170 also preferably defines the plane in which the ignition source 76 and the fuel port 166 are preferably located. The moveable flat portion 168 thus performs, with respect to the opposing region 170, similarly to how the flat rear surface 40 (FIG. 4) performed with respect to the flat wall assembly 28 of the apparatus 10. Turbulence is created in the combustion volume V1 by the unignited fuel jet, in a manner similar to the configuration shown in FIG. 4.

Once the air/fuel mixture in the first combustion volume V1 is ignited, the flame front travels rapidly across the annular volume V1 and into the second combustion volume V2 through the combustion port 146 as a high-energy flame jet. Directing a separate, unignited fuel jet into the second combustion volume V2 is not an important consideration because the high-energy flame jet itself from the first combustion volume V1 is a sufficient source of turbulence to create an adequate high-energy combustion in the volume V2, which then resultantly fires the piston 16. For the second combustion volume V2 therefore, the ignited high-energy flame jet performs the turbulence function of the unignited fuel jet into the first combustion volume V1. The rest of the operation of this configuration of this embodiment is as described above with respect to FIGS. 5–7 (without the use of the fuel jet as the turbulence source).

Referring now to FIGS. 9–11, a combustion-powered apparatus is generally designated 170, but features of the apparatus 170 that are the same as those described above with reference to FIGS. 1–8 are identified by the same numerical designations.

The apparatus 170 includes a combustion chamber 172 in communication with the piston chamber 104. The piston chamber of the apparatus 170 is preferably the same as that of the apparatus 100, described above (FIGS. 5–8). Preferably, no portion of the piston chamber 104 is located within the combustion chamber 172, and the flat surface 22 of the piston 16 is preferably in the general plane of an annular wall 174 of the combustion chamber when in the ready position. The combustion chamber 172 is preferably cylindrical and does not move relative to the piston chamber 104.

A moveable cup 176 moves relative to both the combustion chamber 172 and the piston chamber 104. The moveable cup includes a generally flat plate 178 and a ring wall 180 attached to flat portion along one entire edge 182 of the ring wall. The ring wall 180 is preferably tubular, and has a cylindrical diameter slightly larger than the outer wall 118 of the piston chamber 104. The flat plate 178 is generally parallel to the annular wall 174, and includes an annular portion 184 that extends from the ring wall 180 toward an inner wall 186 of the combustion chamber 172. The inner wall 186 is also preferably a tube, and the annular portion 184 is configured to have an outer periphery 188 slightly smaller than a diameter of the inner wall. A mixing seal 190, which is preferably a combustion-resistant o-ring, prevents airflow between the outer periphery 188 of the flat plate 178 and the inner wall 186.

As best seen in FIG. 9, when in the ready position, a volume of air between the flat plate 178 and both the annular wall 174 and the piston flat surface 22 is practically zero. The mixing volume Vm is therefore defined within the combustion chamber 172 between the flat plate 178 and a rear wall 192 of the combustion chamber. The rear wall 192 is preferably generally flat, and also generally parallel to both the annular wall 174 and the plate 178. The moveable cup 176 is preferably held in the ready position by a spring 194 attached to both a fixed portion 196 of the apparatus 170 and an extension 198 of the ring wall 180. The ring wall extension 198 is preferably also a tube formed together with, or attached to, the ring wall 180, but may also be a single rod, or a plurality of rods.

When in the ready position, fuel is preferably injected into the mixing volume Vm through a fuel valve 200 located on the inner wall 186 of the combustion chamber 172, to mix with air that enters the mixing volume Vm through a first air intake port 202. A first air check valve 204 prevents backflow through the air intake port 202.

Referring now to FIG. 10, when a work contact element 206 is pressed against the workpiece, the work contact element pushes the ring wall extension 198 in the direction A, thereby moving the moveable cup 176 toward the rear wall 192 of the combustion chamber 172, and effectively reducing to zero the mixing volume Vm when in the fully opened position. The fuel/air mixture from the mixing volume Vm enters the first combustion volume V1 through a second air intake port 208 and a one-way second air check valve 210, and into the second combustion volume V2 through a third air intake port 212 and a one-way third air check valve 214.

A flange 216 is located on the ring wall 180 between the ring wall and the ring wall extension 198, and generally conforms to the shape of the ring wall, but extends outward from either side of the ring wall. When the moveable cup 176 is in the fully opened position, the flange 216 contacts a first purging seal 218 and a second purging seal 220, to close airflow through a first purging opening 222 between the annular wall 174 of the combustion chamber 172 and the ring wall 180, and through a second purging opening 224 between the ring wall and the outer wall 118 of the piston chamber 104, respectively. The first and second purging seals 218, 220 are preferably constructed similarly to the seals described above.

In this embodiment, when the moveable cup is in the fully opened position, the combustion chamber is divided into two effective combustion volumes V1 and V2, and the third mixing volume Vm is effectively eliminated. Also in this embodiment, the annular first combustion volume V1 preferably surrounds the cylindrical second combustion volume V2 instead of the piston chamber 104, and both combustion volumes align along their respective planar borders parallel to the annular wall 174 and the rear wall 192 of the combustion chamber 172. And except for this different structural placement, the combustion volumes V1 and V2 otherwise function the same as described above with respect to the apparatus 100.

When in the fully opened position, activation of a trigger (not shown) causes a spark from the ignition source 76 to ignite the fuel/air mixture in the first combustion volume V1. The ignition source is preferably located on the annular wall 174 of the combustion chamber 172. The ignited flame front travels through the first combustion volume V1 until reaching, and exiting through, a combustion port 226. The combustion port 226 may be located on the ring wall 180 to directly connect the first and second combustion volumes V1 and V2, but more preferably the combustion port is located on the annular portion 184 of the flat plate 178 facing the rear wall 192 of the combustion chamber 172. The present inventors further contemplate that, for some circumstances, it may also be preferable to inject fuel directly into the first combustion volume V1 from the fuel valve 200, and particularly if and when there is a significant delay between the movement of the moveable cup to the fully opened position, and the activation of the trigger.

When the combustion port 226 is located on the annular portion 184, a combustion recess 228 is preferably formed in the rear wall 192 of the combustion chamber 172 to create a path for the high-energy flame jet to travel. The third air intake port 212 is therefore preferably located near the combustion recess 228 and the combustion port 226 such that the combustion recess can provide a continuous path for the flame jet to travel from the first combustion volume V1 through the combustion port 226 into the combustion recess 228, and then from the combustion recess 228 through the third air intake port 212 into the second combustion volume V2 to ignite that volume as well. To allow for a maximum distance for the flame front to travel, it is preferable that the combustion port 226, the combustion recess 228, and the third air intake port 212 be located at a distance farthest away from the ignition source 76. The present inventors also contemplate that it can be advantageous to locate the second air intake port 208, where the most airflow turbulence is created, on the annular portion 184 nearest the ignition source 76, and to located the first air check valve 204 within the combustion recess 228 to allow a maximum displacement of the mixing volume Vm.

Similar to with the apparatus 100, described above, the flame jet into the second combustion volume V2 provides both the desired turbulence and ignition of the air/fuel mixture within that volume to create a high-energy combustion. This combustion in the second combustion volume V2 then drives the piston 16 in the direction C, as best seen in FIG. 11.

Referring now to FIG. 11, excess ignited gas exits the piston chamber 104 through the exhaust port 78, and the combustion by-products within the piston chamber and the combustion volumes V1 and V2 cool. The cooling gases within the apparatus 170 create a vacuum effect that pulls the piston 16 back toward the combustion chamber 172. The relative volumes of the piston chamber 104 and the second combustion volume V2 are preferably configured so as to allow the vacuum effect to fully return the piston 16 to the original, ready position (best seen in FIG. 10) without requiring separate, mechanical tension on the piston. As the work contact element 206 is removed from the workpiece, tension from the spring 194 moves the moveable cup 176 back to its original, ready position as well (best seen in FIG. 9) for the next combustion event. Residual combustion by-products within the two combustion volumes are purged through the first and second purging openings 222 and 224 that reappear as the flange 216 moves in the direction C.

According to this embodiment of the present invention, the need for pawls can be entirely eliminated, and the need for springs reduced to a minimum. This embodiment provides a "cup within a cup" (moveable cup within a combustion chamber) configuration which gives all of the advantages described above for multiple-volume apparatuses, but at the same time also allows for the significantly more compact geometry closer to that of single volume apparatuses.

Utilization of moveable plugs and or cup-shaped walls therefore, allow combustion-powered tools according to the present invention to adapt the turbulence generation methods, described above for a single-volume combustion chamber, to multiple-volume combustion apparatuses. The present invention can thus be adapted to both lower- and higher-energy combustion-powered fastener-driving operations. Furthermore, although the present invention has been described in relation to single-, dual-, and triple-volume combustion apparatuses, those skilled in the art will know that the basic principles of the present invention may be utilized in combustion apparatuses employing any number of volumes in their structure, with departing from the present invention.

Those skilled in the art are further apprised that combustion apparatuses, such as in the present invention, may also be effectively employed in other devices which drive a piston, or devices that may be powered by combustion in general. While particular embodiments of the combustion-powered apparatus of the present invention have been shown and described, it will also be appreciated by those skilled in the art that changes and modifications may be made thereto without departing from the invention in its broader aspects, and as set forth in the following claims.

What is claimed is:

1. A gas combustion powered apparatus, comprising:

a piston chamber housing a driveable piston;

a combustion chamber having a generally flat wall assembly and a cup-shaped wall defining at least one combustion volume therebetween, said cup-shaped wall moveable in relation to said piston chamber and having a generally flat portion opposing, and generally parallel to, said generally flat wall assembly;

an ignition source in operable relationship to said at least one combustion volume, to ignite a combustible gas within said at least one combustion volume;

said piston forming at least a portion of said generally flat wall assembly when said piston is in an undriven state, and said driveable piston returnable to said undriven state by vacuum pressure within said combustion chamber.

2. The apparatus of claim 1, wherein said moveable cup-shaped wall has a fully closed position and a fully opened position, said at least one combustion volume being reduced to approximately zero in said fully closed position.

3. The apparatus of claim 2, wherein at least a second portion of said generally flat portion of said cup-shaped wall contacts at least a portion of said generally flat wall assembly when in said fully closed position.

4. The apparatus of claim 2, wherein a movement of said moveable cup-shaped wall from said fully closed position to said fully opened position generates an air turbulence within said at least one combustion volume.

5. The apparatus of claim 2, wherein an area of said generally flat portion of said cup-shaped wall is approximately equal to an area of said generally flat wall assembly.

6. The apparatus of claim 2, further comprising:

a moveable work contact element for engaging a workpiece; and said movement of said moveable cup-shaped wall is operably linked to a movement of said work contact element.

7. The apparatus of claim 6, wherein said cup-shaped wall is fixed to move directly with said movement of said work contact element.

8. The apparatus of claim 7, wherein turbulence is created in a vicinity of said ignition source by an injected high-speed fuel jet.

9. The apparatus of claim 8, wherein said fuel jet is injected through a fuel port located on a wall of said combustion chamber, said fuel port and said ignition source being generally configured in a plane of said generally flat wall assembly.

10. The apparatus of claim 9, wherein said fuel port and said ignition source are located at opposing positions along said flat wall assembly, with respect to a center of said flat wall assembly.

11. The apparatus of claim 10, wherein said fuel jet is injected into said combustion chamber in a direction toward a center of said generally flat portion of said cup-shaped wall opposite to said center of said flat wall assembly.

12. The apparatus of claim 6, wherein said cup-shaped wall is operably connected to said work contact element by a spring tension.

13. The apparatus of claim 12, further comprising:

a first moveable pawl capable of locking said cup-shaped wall in said fully closed position;

said movement of said work contact element creating a tension in said spring; and activation of a trigger causes said first pawl to move to unlock said cup-shaped wall, thereby allowing said spring tension to move said cup-shaped wall to said fully opened position.

14. The apparatus of claim 13, further comprising a second pawl capable of locking said cup-shaped wall in said fully opened position.

15. The apparatus of claim 2, wherein said cup-shaped wall forms a portion of said combustion chamber structure, and said combustion chamber opens when said combustion volume is in said fully open position and closes when said combustion volume is in said fully closed position.

16. The apparatus of claim 2, wherein said cup-shaped wall is a moveable plug located within an interior of said combustion chamber.

17. The apparatus of claim 16, wherein an outer periphery of said moveable plug generally conforms to an inner wall of said combustion chamber.

18. The apparatus of claim 17, wherein a position of said moveable plug within said combustion chamber defines a single mixing volume in said combustion chamber when in said fully closed position, and defines at least a first combustion volume and a second combustion volume within said combustion chamber when in said fully opened position.

19. The apparatus of claim 18, wherein said first combustion volume is represented by V1, said second combustion volume is represented by V2, said mixing volume is represented by Vm, and a formula is generally satisfied when $$Vm(\text{fully closed position})=Vm(\text{not fully closed position})+V1+V2.$$

20. The apparatus of claim 18, wherein said second combustion volume is substantially equal to a volume within said combustion chamber displaced by a location within said combustion chamber of at least a portion of said piston chamber.

21. The apparatus of claim 20, wherein said first combustion volume is annular, and said second combustion volume is cylindrical.

22. The apparatus of claim 21, wherein an inner diameter of said annular first combustion volume is substantially equal to an outer diameter of said cylindrical second combustion volume.

23. The apparatus of claim 18, further comprising:

a fuel port located on said generally flat portion of said moveable plug, and allowing communication from said mixing volume into said second combustion volume when not in said fully closed position; and a combustion port located on a ring-shaped portion of said moveable plug, and allowing communication between said first and second combustion volumes when not in said fully closed position.

24. The apparatus of claim 23, wherein when not in said fully opened position, airflow is allowable between said first and second combustion volumes through an opening between said combustion volumes which is different from said combustion port, and airflow is blocked between said first combustion volume and said mixing volume.

25. The apparatus of claim 23, wherein when not in said fully opened position, airflow is allowable between said first and second combustion volumes through an opening between said combustion volumes which is different from said combustion port, and airflow is allowable between said first combustion volume and said mixing volume through an opening between said mixing and first combustion volumes.

26. The apparatus of claim 23, wherein said fuel port and said combustion port are the only airflow communication means between the mixing, first combustion, and second combustion volumes.

27. The apparatus of claim 16, further comprising:

a moveable work contact element for engaging a workpiece; and a stem portion attached to said moveable plug and extending through an opening in said combustion chamber for operable linkage with said work contact element.

* * * * *